US008191315B1

(12) United States Patent
Brochu

(10) Patent No.: US 8,191,315 B1
(45) Date of Patent: Jun. 5, 2012

(54) EAVESTROUGH COVER

(76) Inventor: Stephane Brochu, St-Romuald (CA)

( * ) Notice: Subject to any disclaimer, the term of this patent is extended or adjusted under 35 U.S.C. 154(b) by 0 days.

(21) Appl. No.: 12/930,668

(22) Filed: Jan. 13, 2011

(51) Int. Cl.
*E04D 13/00* (2006.01)

(52) U.S. Cl. ..... 52/12; 248/48.1

(58) Field of Classification Search ..... 52/11–16; 248/48.1–48.2; 210/474
See application file for complete search history.

(56) References Cited

U.S. PATENT DOCUMENTS

| | | | | |
|---|---|---|---|---|
| 2,271,081 | A * | 1/1942 | Layton | 52/12 |
| 5,459,965 | A * | 10/1995 | Meckstroth | 52/12 |
| 6,412,228 | B1 * | 7/2002 | Meckstroth | 52/12 |
| 6,427,388 | B1 * | 8/2002 | Brochu | 52/12 |
| 6,598,352 | B2 * | 7/2003 | Higginbotham | 52/12 |
| 6,786,008 | B2 * | 9/2004 | Brochu | 52/12 |
| 6,993,871 | B2 * | 2/2006 | Richard et al. | 52/11 |
| 7,614,185 | B2 * | 11/2009 | Brochu | 52/11 |
| 7,624,541 | B2 * | 12/2009 | Gentry | 52/12 |
| 7,627,991 | B1 * | 12/2009 | Feldhaus | 52/12 |
| 7,793,465 | B2 * | 9/2010 | McCann | 52/12 |
| 8,001,729 | B2 * | 8/2011 | Joly et al. | 52/12 |
| 2006/0196124 | A1 * | 9/2006 | Bachman | 52/12 |

* cited by examiner

*Primary Examiner* — William Gilbert
*Assistant Examiner* — Chi Q Nguyen
(74) *Attorney, Agent, or Firm* — Eric Fincham

(57) ABSTRACT

A combination of an eavestrough and a cover therefore, the eavestrough having a bottom wall, a rear wall and a front wall, the front wall terminating in a segment extending outwardly and downwardly from a distal end of the front wall. The cover overlies the eavestrough and has a side structure adjacent the front wall which forms a recess to receive the segment of the front eavestrough wall which extends downwardly and outwardly from a distal end thereof.

10 Claims, 2 Drawing Sheets

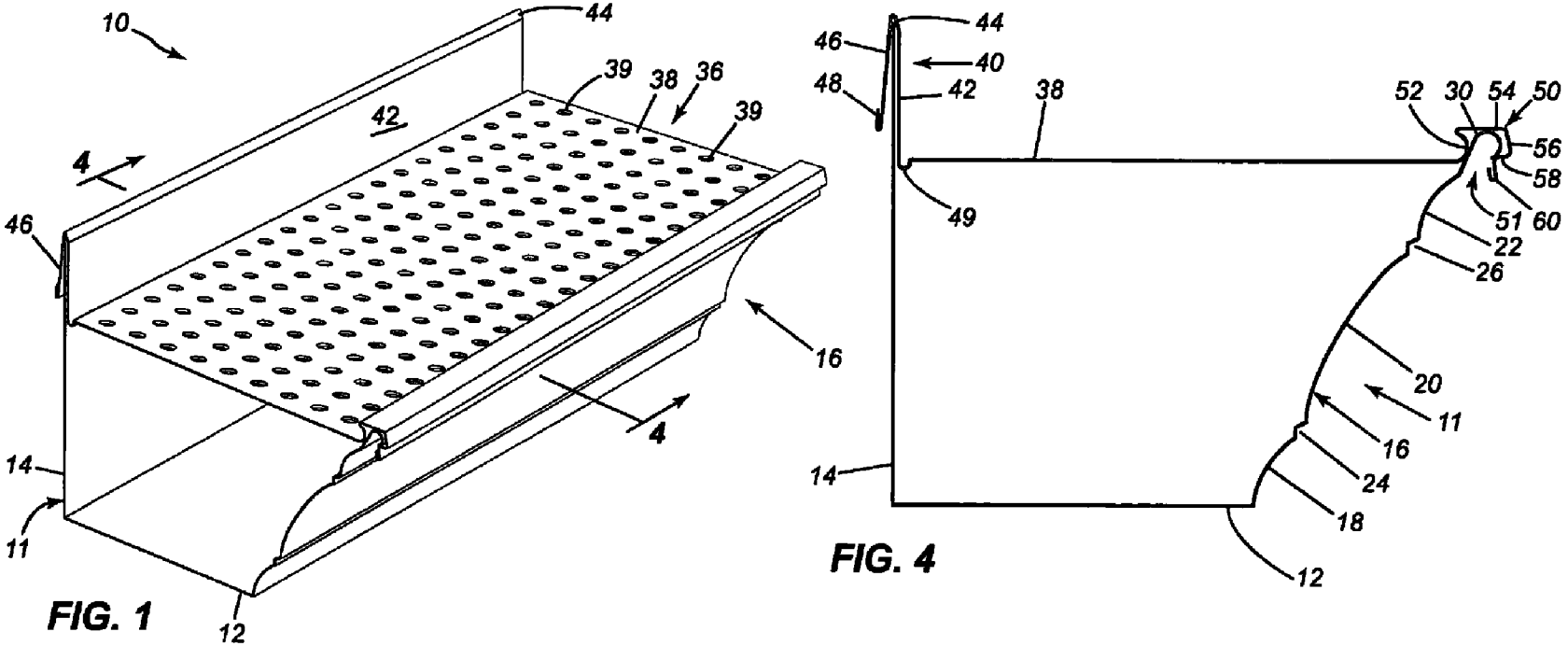
FIG. 1
FIG. 4
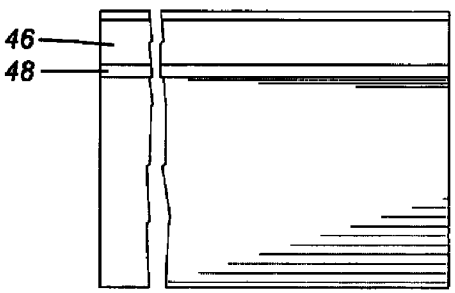
FIG. 2
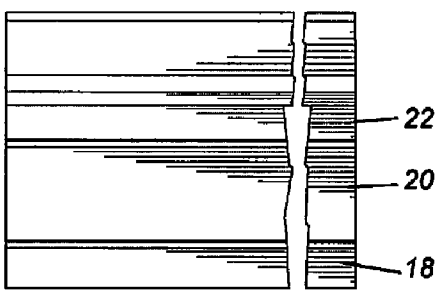
FIG. 3

EAVESTROUGH COVER

FIELD OF THE INVENTION

The present invention relates to an eavestrough or gutter assembly and more particularly, relates to improvements to such structures.

BACKGROUND OF THE INVENTION

The use of shields or gutters or eavestroughs is well known in the prior art and there have been many proposals for different types of shields. The purpose of the shield is essentially to permit passage of rainwater from the roof to the eavestrough while protecting the same from extraneous foreign matter such as leaves and the like.

To-date, there have been several different approaches taken. A first approach is utilizing a shield or a guard which is apertured and permits the passage of rainwater while extensively barring the passage of extraneous material. Moreover, many of these guards do not function as desired and access must still be had to the eavestrough for cleaning purposes.

It has also been proposed in the art to provide relatively complex structures wherein eavestroughs are mounted for rotatable movement such that they may be emptied at desired intervals.

There have also been proposals in the art for gutters and eavestroughs which have a design wherein a cover has an outer edge which curls downwardly and the water flow follows a curved portion due to surface tension and thereafter cascades into the eavestrough. However, this concept suffers when the volume of water becomes sufficiently large, the surface tension is insufficient to cause all the water to flow into the gutter.

SUMMARY OF THE INVENTION

It is an object of the present invention to provide a novel eavestrough with an associated cover or gutter guard.

According to one aspect of the present invention there is provided, in combination, an eavestrough and a cover, the eavestrough comprising a bottom wall, a rear wall extending upwardly therefrom, a front wall extending upwardly and outwardly from the bottom wall, the front wall, the rear wall and the bottom wall defining a trough, the front wall terminating in a segment extending outwardly and downwardly from a distal end of the front wall, the cover overlying the trough, the cover having a planar central portion, the planar central portion having a plurality of apertures formed therein, a first side structure interfacing with the rear wall, a second side structure of the cover interfacing with the front wall, the second side structure including a recess, the segment of the front wall extending into the recess and being retained therein.

The device of the present invention may be formed of any suitable material and would conveniently be formed either of a metallic or plastic material. Thus, both materials are known for use in gutters and one may use either a similar or dissimilar material.

The eavestrough has a novel and aesthetically pleasing configuration. There are provided a plurality of sculpted arcuate inwardly extending segments. Each segment has a somewhat C-shaped configuration. The segments are separated from each other by inwardly extending V-shaped portions.

To provide for easy attachment to the facia of a building, the rear wall preferably extends upwardly to have a greater height than the front wall.

BRIEF DESCRIPTION OF THE DRAWINGS

Having thus generally described the invention, reference will be made to the accompanying drawings illustrating embodiments thereof, in which:

FIG. 1 is a perspective view of a gutter and cover assembly according to one embodiment of the present invention;

FIG. 2 is a rear elevational view thereof;

FIG. 3 is a front elevational view thereof;

FIG. 4 is a cross sectional view taken along the lines 4-4 of FIG. 1;

DETAILED DESCRIPTION OF THE INVENTION

Figure 8:
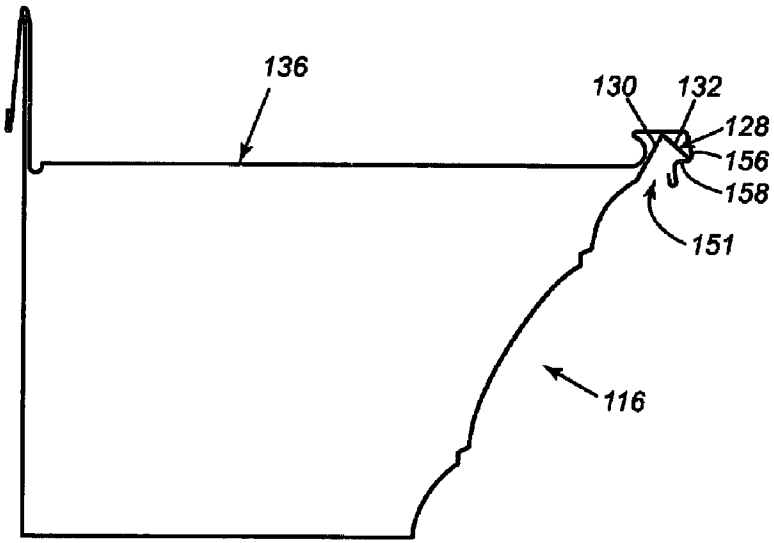
FIG. 8 is a cross sectional view taken along the lines 8-8 of FIG. 5.

Referring to the drawings in greater detail and by reference characters thereto, there is illustrated an eavestrough and associated cover and which are generally designated by reference numeral 10.

An eavestrough 11 has a bottom wall 12, a rear wall 14, and a front wall 16 extending upwardly and outwardly from bottom wall 12. Front wall 16 is sculpted to have an arcuate inwardly extending segment 18, segments 18, 20 and 22 are connected together by first and second V-shaped portions 24, 26. As may be seen more clearly in FIG. 4, arcuate inwardly extending segments 18 and 22 are approximately of the same dimensions while intermediate arcuate inwardly extending segment 20 is of a substantially greater length than segments 18, 22. At the distal end of front wall 16, there is provided an arcuate U-shaped segment 30.

A cover generally designated by reference numeral 36 includes a planar central portion 38 having a plurality of drainage apertures 39 extending therethrough. At one side edge of cover 36, there is provided a first side structure generally designated by reference numeral 40. First side structure 40 includes an upwardly extending wall 42 which extends to the upper marginal edge of rear wall 14 of eavestrough 11. At its very upper end, upwardly extending wall 42 has an angled segment 44 which meets with a downwardly extending wall 46. Downwardly extending wall 46 is finished with an end segment 48. As may be seen, wall 42, segment 44 and wall 46 enclose the upper portion of rear wall 14. For additional rigidity, it will be noted that there is a U-shaped formation 49 at the point of joinder of upwardly extending wall 42 and planar central portion 38.

At the opposite side of planar central portion 38, there is provided a second side structure generally designated by reference numeral 50. Second side structure 50 includes an upwardly extending wall 52 having a reverse C-shaped configuration. Upwardly extending wall 52 merges with a top wall 54 which in turn merges with a side wall 56 which extends downwardly. There is also provided an inwardly extending lower wall 58 which terminates in an end portion 60.

As may be seen in the drawings and as shown more clearly in FIG. 4, arcuate U-shaped portion 30 of front wall 16 fits within a recess 51 defined by upwardly extending wall 52, top wall 54, side wall 56 and inwardly extending lower wall 58. As illustrated in the drawings, arcuate U-shaped portion 30 contacts upwardly extending wall 52 and inwardly extending lower wall 58. The gap or opening between upwardly extending wall 52 and inwardly extending lower wall 58 is designed to be slightly smaller than the width of arcuate U-shaped portion 30 such that it is retained within the recess. 51 Arcuate U-shaped portion 30 can enter the recess 51 due to a slight flexibility in the components, but it does not easily exit from the recess.

In the above structure, a rigid overall eavestrough and cover 10 is obtained. The product is aesthetically pleasing as well as structurally solid.

Figure 5:
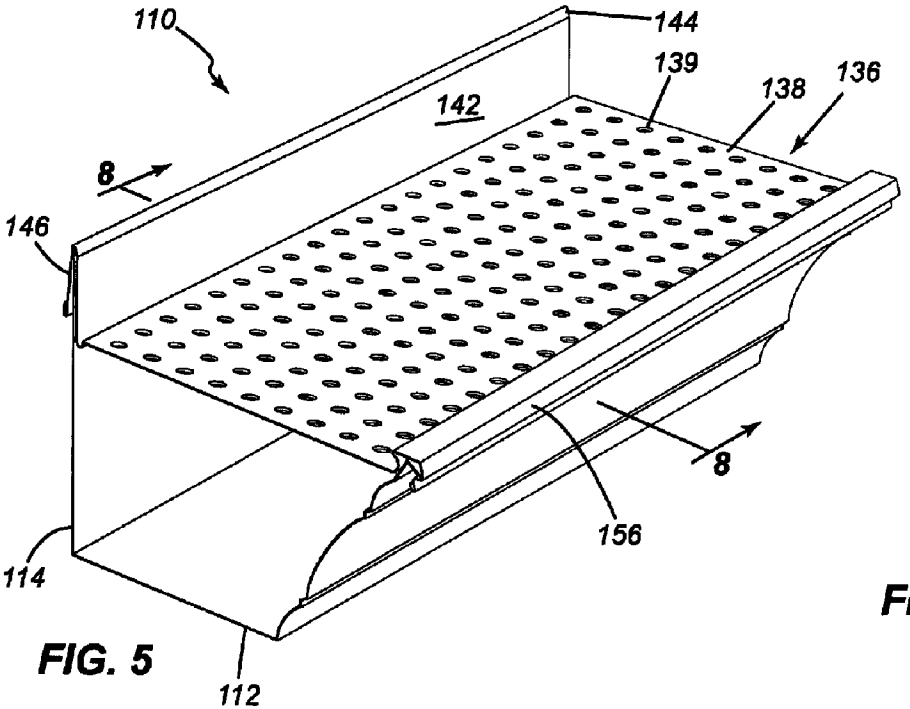
FIG. 5 is a perspective view of a further embodiment of an eavestrough and gutter according to the present invention.
Figure 7:
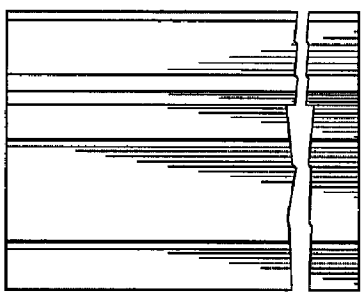
FIG. 7 is a front elevational view thereof.
Figure 6:
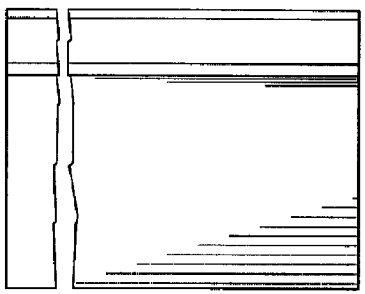
FIG. 6 is a rear elevational view thereof.

A second embodiment is illustrated in FIGS. 5 to 8 and will now be referred to. As many components are similar, similar reference numerals in the 100's are employed for similar components.

In this embodiment, there is again provided an eavestrough and cover 110 which includes an eavestrough 110 having a bottom wall 112, a rear wall 114, and a front wall 116. At the upper end of front wall 116, there is provided a V-shaped segment 128 which comprises a first wall 130 and a second downwardly extending wall 132. If desired, wall 132 may terminate with a folded back segment. In this arrangement, V-shaped segment 128 is arranged such that V-shaped segment 128 fits within the recess 151 of cover 136 as in the previously described embodiment. However, in this arrangement, second downwardly extending wall 132 contacts the corner formed by side wall 156 and inwardly extending lower wall 158. Again, in this arrangement, insertion of V-shaped segment 128 is possible due to the slight flexibility of the components and as might be seen from FIG. 8, withdrawal from the recess is not easily achieved.

It will be understood that the above described embodiments are for purposes of illustration only and that changes and modifications may be made thereto without departing from the spirit and scope of the invention. Thus different complementary configurations for the locking portion may be utilized.

I claim:

1. In combination, an eavestrough and a cover, said eavestrough comprising:

a bottom wall:

a rear wall extending upwardly therefrom;

a front wall extending upwardly and outwardly from said bottom wall, said front wall, said rear wall and said bottom wall defining a trough, said front wall terminating in a segment extending outwardly and downwardly from a distal end of said front wall;

said cover overlying said trough;

said cover having a planar central portion, said planar central portion having a plurality of apertures formed therein;

a first side structure interfacing with said rear wall;

a second side structure of said cover interfacing with said front wall, said second side structure including a recess, second side structure having an upwardly extending wall, a top wall extending outwardly from said upwardly extending wall, and a side wall extending downwardly from said top wall, and a lower wall extending inwardly from said side wall, said recess being defined by said upwardly extending wall, said top wall, said side wall and said inwardly extending segment;

said segment of said front wall extending into said recess and being retained therein.

2. The combination of claim 1 wherein said segment of said front wall extending into said recess comprises an arcuate segment extending outwardly and downwardly.

3. The combination of claim 2 wherein said upwardly extending wall has an arcuate reverse C-shape configuration.

4. The combination of claim 2 wherein said top wall slopes upwardly from said upwardly extending wall to said side wall.

5. The combination of claim 1 wherein said segment of said front wall extending into said recess comprises a first portion extending upwardly and outwardly and a second portion extending downwardly and outwardly.

6. The combination of claim 5 wherein said second portion is straight and a free end of said second portion extends to proximate where said side wall and said lower wall meet.

7. The combination of claim 5 wherein said upwardly extending wall has an arcuate reverse C-shape configuration.

8. The combination of claim 5 wherein said top wall slopes upwardly from said upwardly extending wall to said side wall.

9. The combination of claim 1 wherein said front wall has a plurality of arcuate inwardly extending segments formed therein.

10. The combination of claim 9 wherein each of said arcuate inwardly extending segments is separated from an adjacent arcuate inwardly extending segment by an inwardly extending V-shape portion.

* * * * *